US009377802B1

(12) United States Patent
Wyland et al.

(10) Patent No.: US 9,377,802 B1
(45) Date of Patent: Jun. 28, 2016

(54) DYNAMIC CONFIGURATION OF EQUIVALENT SERIES RESISTANCE

(75) Inventors: Christopher P. Wyland, Livermore, CA (US); Romi Mayder, San Jose, CA (US); Paul Y. Wu, Saratoga, CA (US)

(73) Assignee: XILINX, INC., San Jose, CA (US)

( * ) Notice: Subject to any disclaimer, the term of this patent is extended or adjusted under 35 U.S.C. 154(b) by 1149 days.

(21) Appl. No.: 13/414,387

(22) Filed: Mar. 7, 2012

(51) Int. Cl.

| | |
|---|---|
| ***G05F 1/652*** | (2006.01) |
| ***G05F 1/63*** | (2006.01) |
| *G05F 1/44* | (2006.01) |
| *G05F 1/12* | (2006.01) |

(52) U.S. Cl.
CPC *G05F 1/652* (2013.01); *G05F 1/63* (2013.01); *G05F 1/12* (2013.01); *G05F 1/44* (2013.01)

(58) Field of Classification Search
CPC ..... G05F 1/12; G05F 1/44; G05F 1/652; G05F 1/63
USPC ..... 323/299, 298, 353
See application file for complete search history.

(56) References Cited

U.S. PATENT DOCUMENTS 6,144,225 A 11/2000 Lesea
6,163,143 A * 12/2000 Shimamori ..... H02M 3/157 323/284
6,172,611 B1 * 1/2001 Hussain ..... G06F 1/206 340/584
7,622,820 B1 * 11/2009 Prodic ..... H02M 3/156 307/31
8,716,898 B1 * 5/2014 Liu ..... H01L 23/00 307/102
2005/0122214 A1 * 6/2005 Lin ..... B60C 23/041 340/442
2010/0039099 A1 * 2/2010 Kim ..... H03H 1/0007 324/120
2011/0043220 A1 * 2/2011 Leibowitz ..... G06F 1/26 324/613

OTHER PUBLICATIONS

U.S. Appl. No. 12/949,518, filed Nov. 18, 2010, Mayder et al.

* cited by examiner

*Primary Examiner* — Fred E Finch, III
*Assistant Examiner* — Rafael O. De Leon Domenech
(74) *Attorney, Agent, or Firm* — LeRoy D. Maunu

(57) ABSTRACT

In one embodiment, an integrated circuit (IC) includes a power distribution network having a first set of power distribution lines connected to a source voltage and a second set of power distribution lines connected to a ground voltage, and a first capacitor. A first variable resistive element is electrically coupled in series with the first capacitor between the first and second sets of power lines of the power distribution network. A control circuit is coupled to the variable resistive element and is configured and arranged to adjust a level of resistance of the first variable resistive element in response to an input signal. The adjustment of the level of resistance adjusts an equivalent series resistance of the power distribution network.

19 Claims, 6 Drawing Sheets

DYNAMIC CONFIGURATION OF EQUIVALENT SERIES RESISTANCE

FIELD OF THE INVENTION

One or more embodiments generally relate to power distribution networks for integrated circuits (ICs).

BACKGROUND

Electrical systems often include semiconductor devices with very demanding power requirements, such as providing for high current transients with stable voltage over a wide frequency range. A power regulation circuit located on a printed circuit board (PCB) typically generates the voltage used to drive components of an IC. The power regulation circuit observes the regulated output voltage and adjusts the amount of current supplied to keep the voltage constant. The generated voltage is delivered from the regulator to the components by means of a power distribution network (PDN). A PDN includes not only the output ports of a power regulation circuit, but also power distribution lines on the printed circuit board (PCB), additional components mounted on the PCB, the package of the semiconductor IC, and power distribution lines of the IC.

PDNs are configured to accommodate current demands of integrated circuit components and respond to transient changes in those demands as quickly as possible. When the current drawn in a device changes, the power regulation circuit may not be able to respond to that change instantaneously. For example, most voltage regulators adjust the output voltage on the order of milliseconds to microseconds. They are effective at maintaining output voltage for events at all frequencies from DC to a few hundred kilohertz (depending on the regulator). For all transient events that occur at frequencies above this range, there is a time lag between an event and the time at which the voltage regulator can respond to the new level of demand. The PDN should be configured to compensate for this lag. The voltage fluctuations, referred to herein as ripple, can affect timing of the circuit because a perturbed supply voltage modifies the delay of components such as logic gates or interconnects. If the modified delays are not accounted for, the design may not perform as intended.

The power consumed by a digital device varies over time and variations may occur at all frequencies of operation. Low frequency variance of current is usually the result of devices or large portions of devices being enabled or disabled. Similarly, high frequency variance of current often results from individual switching events of components of the IC. These switching events occur on the scale of the clock frequency as well as the first few harmonics of the clock frequency. In addition to ripple resulting from component switching, nonlinear electrical characteristics of the components create additional fluctuations in voltage. These effects were generally ignored in older technologies because of relative slow chip speed and low integration density. However, as speed and density of circuits increase, the unintended effects caused by the parasitic electrical characteristics of components have become significant. Among other effects, inductance of various portions of the PDN, in combination with capacitance of the PDN, can resonate when perturbed.

PDN design for programmable ICs is particularly difficult because transient currents may vary widely depending on the design used to configure the programmable IC. Since programmable ICs can implement an almost infinite number of applications at different frequencies and in multiple clock domains, it can be very complicated to predict transient current demands.

One or more embodiments of the present invention may address one or more of the above issues.

SUMMARY

In one embodiment, an integrated circuit (IC) is provided. The IC includes a power distribution network having a first set of power distribution lines connected to a source voltage, a second set of power distribution lines connected to a ground voltage, and a first capacitor. A first variable resistive element is electrically coupled in series with the first capacitor between the first and second sets of power lines of the power distribution network. A control circuit is coupled to the variable resistive element and is configured to adjust a level of resistance of the first variable resistive element in response to an input signal. The adjustment of the level of resistance adjusts an equivalent series resistance of the power distribution network.

In another embodiment, an IC includes first and second sets of power distribution lines and a plurality of equivalent series resistance (ESR) adjustment circuits. Each ESR adjustment circuit includes a capacitor and a transistor electrically coupled in series between the first and second sets of power distribution lines. A control circuit of the IC is configured to adjust ESR of each ESR adjustment circuit by adjusting a gate voltage of the transistor of the ESR adjustment circuit.

In yet another embodiment, a method is provided for adjusting ESR of an IC. In response to initial application of power to the IC, a level of resistance of a variable resistive element is adjusted. The variable resistive element is coupled in series with a capacitor between a first set of power distribution lines coupled to a source voltage and a second set of power distribution lines coupled to a ground voltage to adjust the ESR of the IC.

It will be appreciated that one or more other embodiments are set forth in the Detailed Description and Claims, which follow.

BRIEF DESCRIPTION OF THE DRAWINGS

Various aspects and advantages of one or more embodiments will become apparent upon review of the following detailed description and upon reference to the drawings, in which:

FIGS. 2-1 and 2-2 show circuits that may be used for dynamic adjustment of equivalent series resistance (ESR) in accordance with one or more embodiments;

DETAILED DESCRIPTION

Decoupling capacitors are used in PDNs to improve stability of power delivered to integrated circuit components. The decoupling capacitors provide a local backup supply of power to compensate for any current fluctuations. Decoupling capacitors may also be referred to as bypass capacitors and such terms are used interchangeably herein. However, decoupling capacitors are subject to limitations that may prevent instant compensation in response to ripple. While an ideal capacitor only has a capacitive characteristic, real non-ideal capacitors also have a parasitic inductance and a parasitic resistance. These parasitics act in series to form a resistance-inductance-capacitance (RLC) circuit. One problem associated with capacitors in a PDN is spikes in the PDN aggregate impedance. These spikes can be caused by a combination of capacitance and inductance in the PDN. If the power distribution lines have an especially low impedance, the crossover frequency between high-frequency decoupling capacitors and the capacitance of the power distribution lines may exhibit a high-impedance peak. Because impedance retards the abilities of bypass capacitors to quickly respond to changing current demands, if the IC has high transient current demand at this frequency, power supply noise may be created.

A PDN may be implemented to include one or more decoupling capacitors on the IC to dissipate noise on the PDN. How quickly the noise dissipates due to the equivalent series resistance (ESR) depends on the amount of inductance in the system power supply path. Due to the variety of PCBs and die packages, the power supply path inductance can vary significantly from one PCB and package combination to another. To minimize the noise, the ESR needs to be tailored for each PCB and package combination. Generally, the ESR is determined during design and manufacture of the die. This may restrict the number of application packages and PCBs that may be used with the die.

One or more embodiments provide an on-die solution for dynamic adjustment of ESR. Such flexibility allows an IC die to be used for a number of different applications requiring different ESR values. A power distribution network of the IC die includes a dynamic ESR circuit that may be dynamically adjusted at run-time by a control circuit to configure the ESR of the power distribution network for a particular application.

Figure 1:
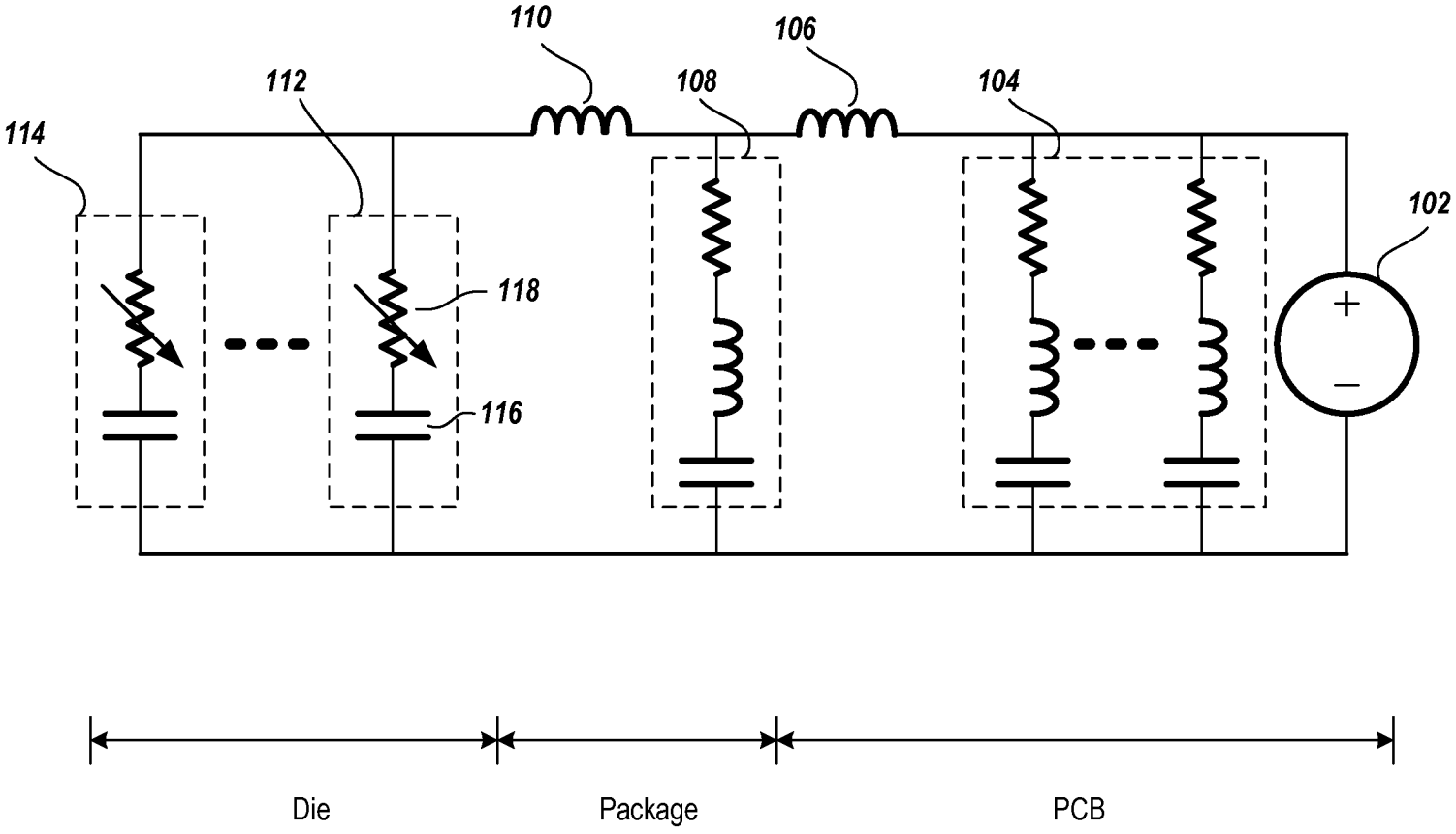
FIG. 1 shows a circuit diagram of a power distribution network, in accordance with one or more embodiments.

FIG. 1 shows a circuit diagram of a PDN. As described above, a typical PDN includes three main segments: the IC die; the die package; and the printed circuit board (PCB) connecting a power regulation circuit 102 to the IC die package. The circuit shown in FIG. 1 provides a basic model of parasitic inductance and capacitance of the PDN. Capacitances and inductance of the PCB are respectively modeled by elements 104 and 106. Capacitances and inductance of the IC package are respectively modeled by elements 108 and 110. In this illustrative example, the PDN includes ESR adjustment circuits 112 and 114. Each ESR adjustment circuit includes a decoupling capacitor and variable resistor coupled in series between a source voltage and ground in the PDN. For example, the ESR adjustment circuit includes capacitor 116 and variable resistor 118. The ESR of a decoupling capacitor in each ESR adjustment circuit can be configured by adjusting the resistance of the connection between the capacitor and the power distribution lines of the PDN by way of the variable resistor.

In this example, the PDN includes two ESR adjustment circuits 112 and 114 formed on the IC. However, it is recognized that other embodiments may implement any number of on-die decoupling capacitors coupled to the power distribution lines. Different types and sizes of capacitors have different levels of effectiveness as decoupling capacitors for different frequency bands. In one or more embodiments, each capacitor may also be implemented with a different capacitance value to distribute the effective decoupling range among multiple capacitors and further smooth the impedance response of the PDN. For example, ESR adjustment circuit 114 may be implemented with a high-ESR capacitor, and ESR adjustment circuit 112 may be implemented with a low-ESR capacitor.

Figures 1, 2:
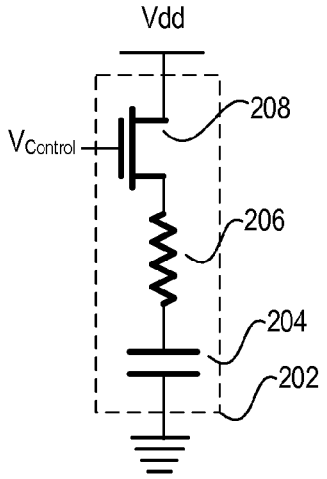
Figure 2:
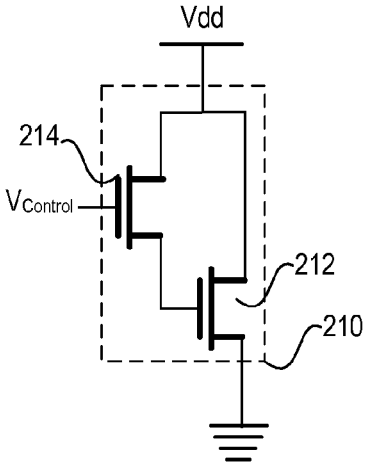

FIGS. 2-1 and 2-2 show example circuits that may be used for dynamic ESR adjustment. FIG. 2.1 shows a dynamic ESR adjustment circuit 202 coupled between Vdd and ground of a power distribution network. The dynamic ESR adjustment circuit includes a decoupling capacitor 204 coupled in series with a resistor 206 and a variable resistor 208. In this example, the variable resistor 208 is implemented using an NMOS transistor. To adjust the ESR of the decoupling capacitor, signal $V_{Control}$ adjusts a gate voltage of NMOS transistor 208 to modify its transconductance. It is recognized that various types of capacitors may also be used to implement the decoupling capacitor. For example, metal-insulator-metal capacitors may be implemented in one layer of the IC, with two interleaved comb-shaped metal plates separated by a dielectric. Each capacitor may also be implemented with three or more stacked metal plates with the dielectric between the plates and neighboring plates coupled to different ones of the power distribution lines. Further details of different metal-insulator-metal capacitors that may be implemented on ICs are described in U.S. Pat. No. 6,144,225, which is incorporated herein by reference.

As another example, the decoupling capacitor(s) may be implemented with MOSFET transistors formed in a layer of the IC. FIG. 2.2 shows another dynamic ESR adjustment circuit 210 coupled between Vdd and Gnd of a power distribution network. Dynamic ESR adjustment circuit 210 includes an NMOS transistor 212 that implements a decoupling capacitor and an NMOS transistor 214 that implements a variable resistor. The gate of transistor 212 is connected to the source/drain of transistor 214. In circuit 210, capacitance for ESR adjustment is provided between the gate and the source of the NMOS transistor 212. It is recognized that other MOSFET arrangements may be used to implement a capacitor as well. For example, a source and drain of a MOSFET may be shorted together to provide a capacitance between the gate or body and the source/drain. Similar to the circuit shown in FIG. 2-1, the ESR of the decoupling capacitor 210 may be adjusted by adjusting a gate voltage of NMOS transistor 214 to modify its transconductance.

Figure 3:
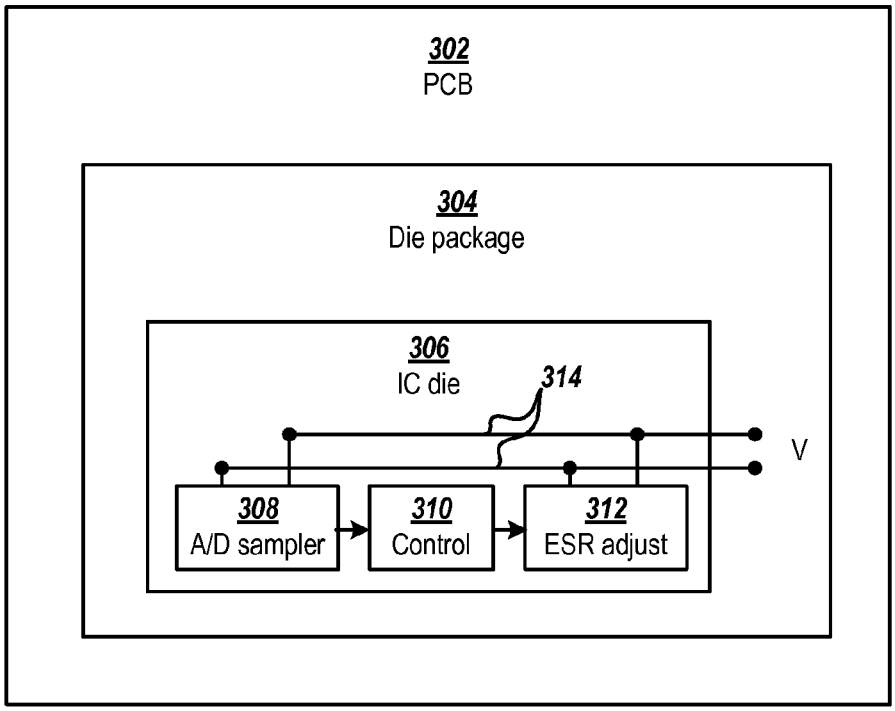
FIG. 3 shows a block diagram of a power distribution network in accordance with one or more embodiments.

FIG. 3 shows a block diagram of a power distribution network in accordance with one or more embodiments. An IC die 306 is implemented in a die package 304 that is mounted on a PCB 302. As described above, the IC die 306 includes an ESR adjustment circuit 312 to dynamically adjust the ESR of power distribution lines 314 of the IC die 306. The ESR of the ESR adjust circuit is adjusted by control circuit 310.

In the embodiment shown in FIG. 3 the control circuit 310 is configured to adjust ESR to minimize noise of the power distribution lines 314 as measured by A/D sampling circuit 308. The A/D sampling circuit 308 is configured to determine a level of noise by sampling voltage levels on the power distribution lines 314. The level of noise may be determined by the amount of difference between sampled voltages and an expected voltage level for the PDN. In some embodiments, the control circuit 310 is configured to adjust the ESR continuously in response to noise levels detected by the ND sampling circuit 308. In some other embodiments, the control circuit 310 may adjust ESR in an initial adjustment period to determine an optimal setting, and thereafter, set the ESR adjustment circuit 312 to exhibit the determined optimal ESR.

In some other embodiments, ESR may be adjusted without monitoring noise of the power distribution network. For example, the control circuit may adjust the ESR to a predetermined level according to a configuration parameter stored in a BRAM of the IC die, for example. As another example, the control circuit may adjust the ESR in response to an external signal provided to the control circuit.

Figure 4:
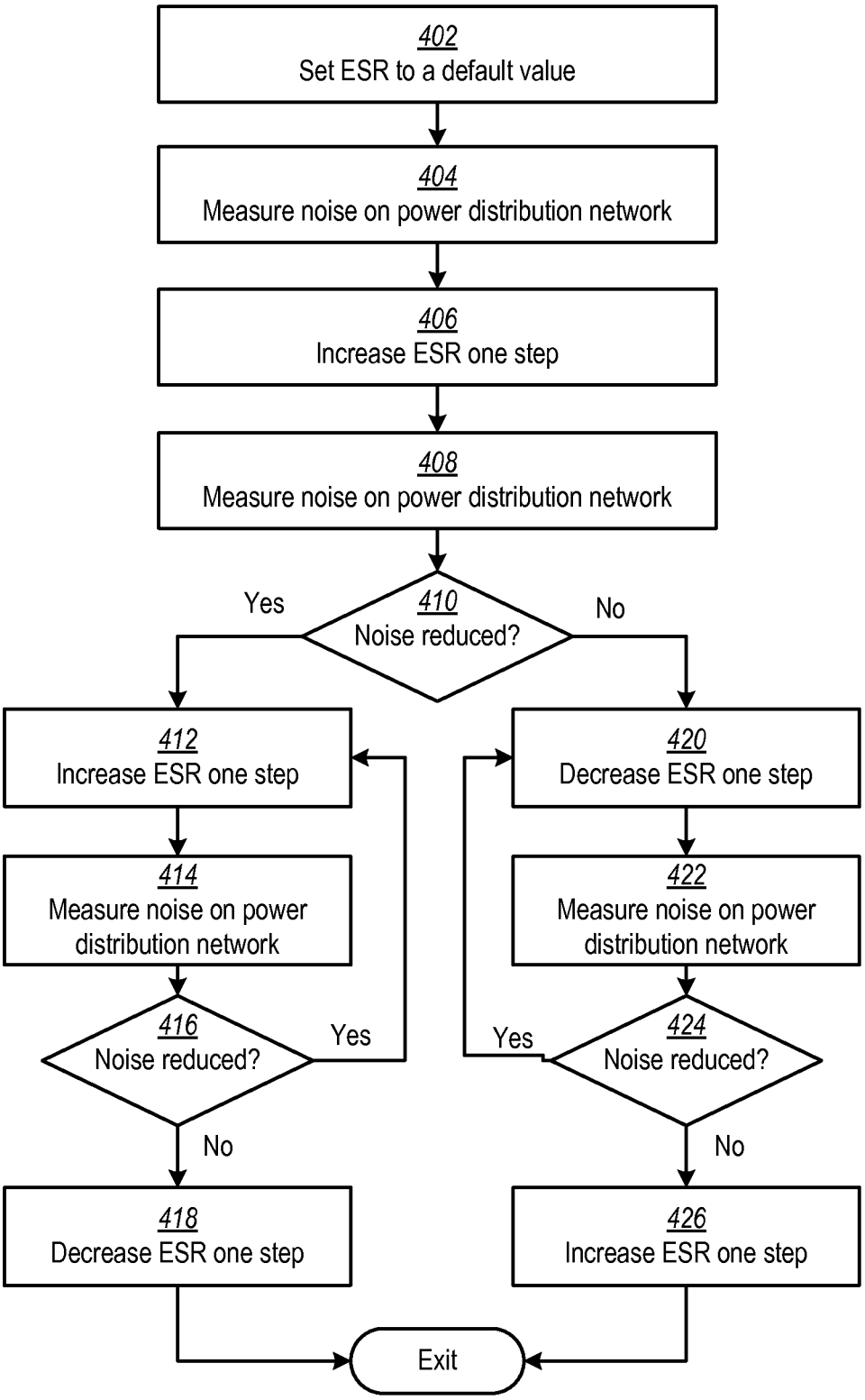
FIG. 4 shows an example process for optimizing ESR at startup to reduce noise present on the power distribution network.

FIG. 4 shows an example process for adjusting the ESR at startup to reduce noise present on the power distribution network. The ESR is set to a default value at block 402. Noise of the power distribution network is measured at block 404. ESR is increased one step at block 406 and measured again at block 408 to determine whether ESR should be increased or decreased. If increasing the ESR at block 406 resulted in a reduction in noise of the power distribution network, decision block 410 directs the process to blocks 412 and 414 where the ESR is repeatedly increased and noise is measured until noise is no longer reduced as determined at decision block 416. If an increase in noise is detected, the ESR is decreased at block 418 to the last ESR setting before the increase in noise was detected.

Similarly, if increasing the ESR at block 406 resulted in an increase in noise of the power distribution network, decision block 410 directs the process to blocks 420 and 422 to repeatedly decrease the ESR and measure the noise until noise is no longer reduced as determined at decision block 424. Once an increase in noise is detected, the ESR is increased at block 426 to the last ESR setting before the increase in noise was detected.

The method in FIG. 4 adjusts the ESR to locate a local minima of noise relative to the starting ESR value. However, it is recognized that the local minima of noise may not be the global minima. Some embodiments may employ further methods to avoid local minima. For example, the method shown in FIG. 4 may be performed a number of times using starting ESR values that are distributed among a range of possible ESR values. The ESR setting that achieves the lowest level of noise may be selected as the ESR setting of the device. However, other methods to avoid local minima may be employed as well.

It is recognized that operating temperature of an integrated circuit may affect the ESR of capacitors. One or more embodiments may be configured to operate in a wide range of operating temperatures (e.g., −60° C. to 150° C.). If ESR adjustment circuits are configured for a first ESR setting at start-up, the ESR exhibited by the circuits may drift as the operating temperature of the IC increases/decreases during operation. One or more embodiments may adjust settings of ESR adjustment circuits as a function of the temperature drift of the circuit. For example, in one embodiment, the ESR of the IC may be adjusted initially at startup using a feedback mechanism to reduce noise. Afterwards, the ESR may be adjusted as a function of temperature of the IC to compensate for ESR drift.

Figure 5:
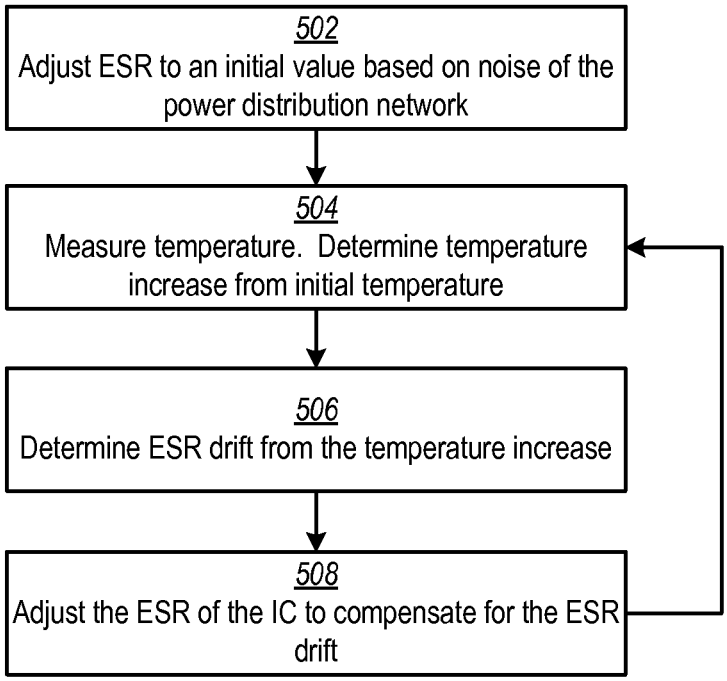
FIG. 5 shows an example process for adjusting ESR as a function of temperature to compensate for ESR drift.

FIG. 5 shows an example process for adjusting ESR as a function of temperature to compensate for ESR drift. The ESR is adjusted to an initial value at block 502 at startup using a feedback mechanism to reduce noise, as described with reference to FIG. 4. After the startup adjustment, the ESR may be adjusted as a function of temperature of the IC to compensate for ESR drift. Temperature is measured at block 504 and a temperature change from an initial temperature is determined. ESR drift is determined from the determined temperature increase at block 506. For example, in one implementation the ESR drift may be retrieved from a table indicating ESR drift or ESR adjustment for a range of temperatures. The ESR is adjusted at block 508 to compensate for the ESR drift.

Temperature increases/decreases can be determined in a number of methods. In one implementation, a temperature sensor (e.g., a temperature sensitive resistor) may be implemented within the IC. When the ESR is initially adjusted at block 502, the initial temperature may be determined. During operation, the temperature indicated by the sensor can be compared to the initial temperature reading to determine temperature increase or decrease experienced by the IC. In another embodiment, a second temperature sensor may be implemented external to the IC, which may be used to monitor room temperature of the operating environment. A temperature increase may be determined during operation by comparing the temperatures measured by the first and second temperature sensors.

Figure 6:
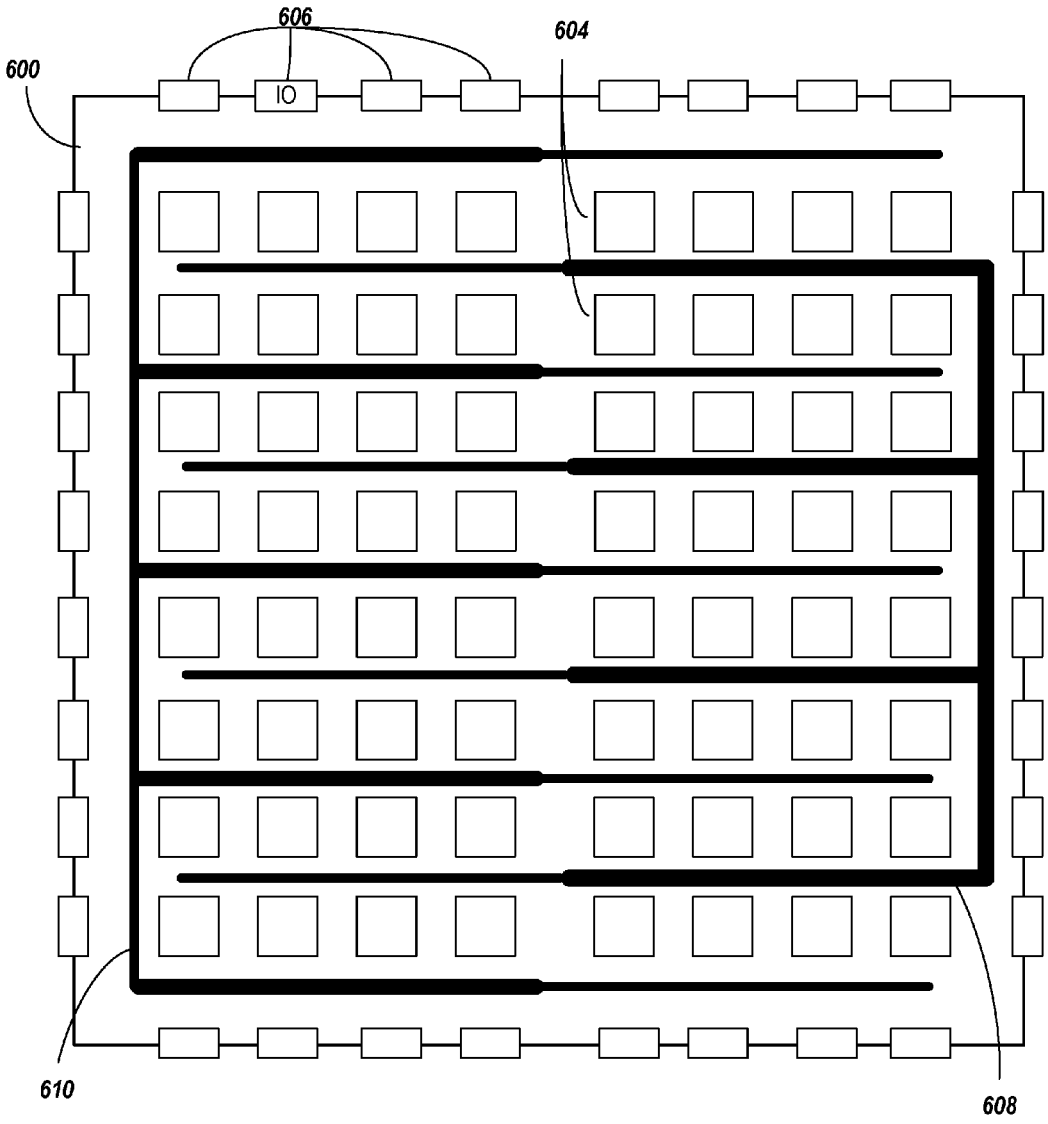
FIG. 6 illustrates an example power line distribution grid of a programmable IC.

FIG. 6 illustrates an example programmable integrated circuit (IC) 600 in which the power distribution lines are located in the same plane as the programmable resources of an IC. The programmable IC includes programmable logic resources 604 and I/O pins 606. Power distribution lines 608 and 610 are placed in a parallel alternating configuration. In this configuration, lines 608 and 610 are joined to respective power and ground terminals (not shown) at opposite ends of the integrated circuit. Decoupling capacitors (not shown) are implemented in a separate layer of the IC and coupled to the power distribution lines 608 and 610. It is understood that one or more embodiments of the present invention are equally applicable to different power distribution line grid arrangements. For example, power distribution lines 608 may be implemented in an IC layer different from the layer in which power distribution lines 610 are implemented and may have cross-hatched layout.

Figure 7:
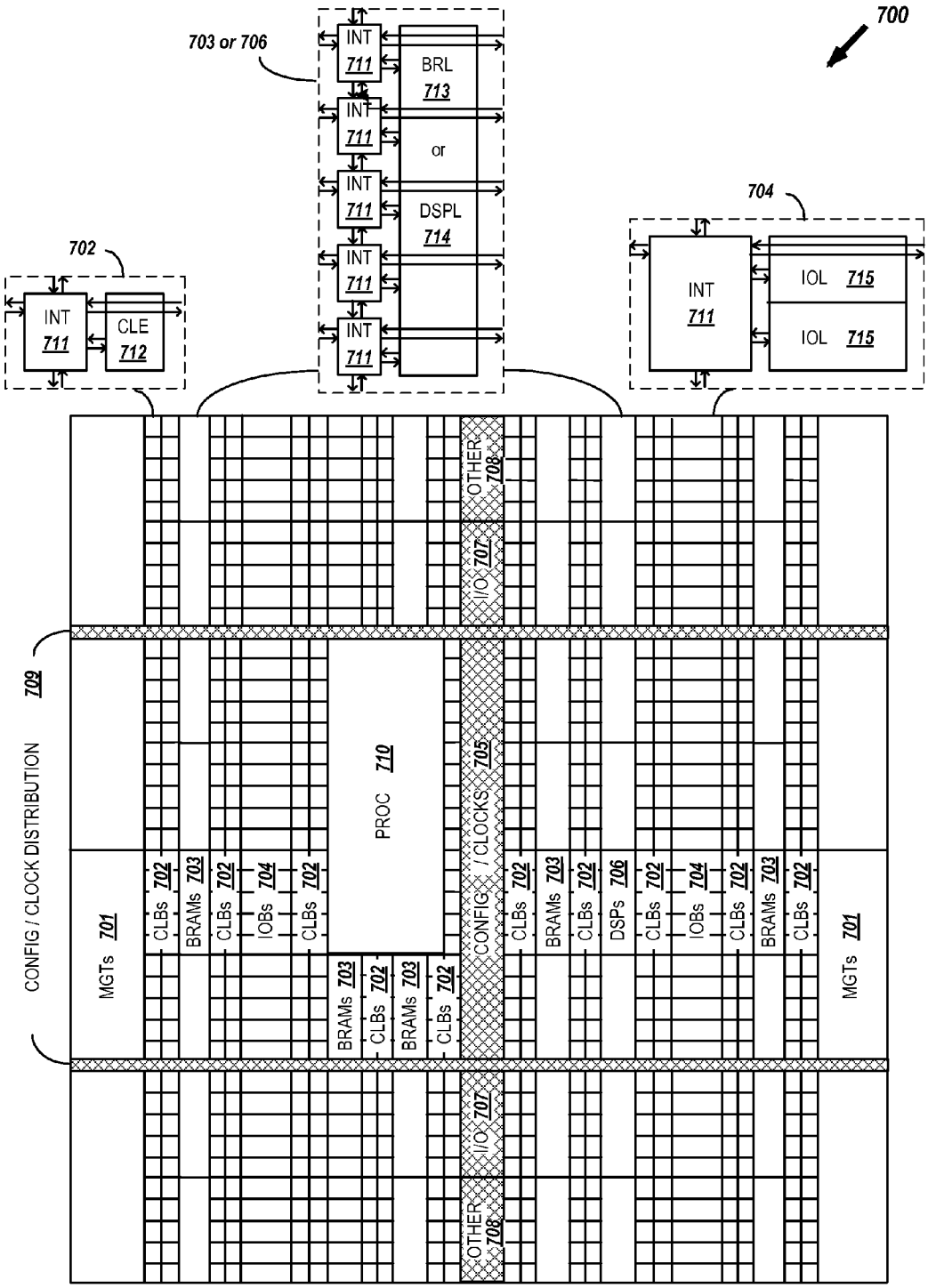
FIG. 7 shows an example programmable IC that may implement a power distribution network in accordance with one or more embodiments.

FIG. 7 is a block diagram of an example programmable integrated circuit that may implement a power distribution network in accordance with one or more embodiments. One particularly versatile programmable IC is a field programmable gate array (FPGA). FPGAs can include several different types of programmable logic blocks in the array. For example, FIG. 7 illustrates an FPGA architecture (700) that includes a large number of different programmable tiles including multi-gigabit transceivers (MGTs 701), configurable logic blocks (CLBs 702), random access memory blocks (BRAMs 703), input/output blocks (IOBs 704), configuration and clocking logic (CONFIG/CLOCKS 705), digital signal processing blocks (DSPs 706), specialized input/output blocks (I/O 707), for example, clock ports, and other programmable logic 708 such as digital clock managers, analog-to-digital converters, system monitoring logic, and so forth. Some FPGAs also include dedicated processor blocks (PROC 710) and internal and external reconfiguration ports (not shown).

In some FPGAs, each programmable tile includes a programmable interconnect element (INT 711) having standardized connections to and from a corresponding interconnect element in each adjacent tile. Therefore, the programmable interconnect elements taken together implement the programmable interconnect structure for the illustrated FPGA. The programmable interconnect element INT 711 also includes the connections to and from the programmable logic element within the same tile, as shown by the examples included at the top of FIG. 7.

For example, a CLB 702 can include a configurable logic element CLE 712 that can be programmed to implement user logic plus a single programmable interconnect element INT 711. A BRAM 703 can include a BRAM logic element (BRL 713) in addition to one or more programmable interconnect elements. Typically, the number of interconnect elements included in a tile depends on the height of the tile. In the pictured embodiment, a BRAM tile has the same height as five CLBs, but other numbers (e.g., four) can also be used. A DSP tile 706 can include a DSP logic element (DSPL 714) in addition to an appropriate number of programmable interconnect elements. An IOB 704 can include, for example, two instances of an input/output logic element (IOL 715) in addition to one instance of the programmable interconnect element INT 711. As will be clear to those of skill in the art, the actual I/O pads connected, for example, to the I/O logic element 715 are manufactured using metal layered above the various illustrated logic blocks, and typically are not confined to the area of the input/output logic element 715.

In the pictured embodiment, a columnar area near the center of the die (shown shaded in FIG. 7) is used for configuration, clock, and other control logic. Horizontal areas 709 extending from this column are used to distribute the clocks and configuration signals across the breadth of the FPGA.

Some FPGAs utilizing the architecture illustrated in FIG. 7 include additional logic blocks that disrupt the regular columnar structure making up a large part of the FPGA. The additional logic blocks can be programmable blocks and/or dedicated logic. For example, the processor block PROC 710 shown in FIG. 7 spans several columns of CLBs and BRAMs.

Note that FIG. 7 is intended to illustrate only an exemplary FPGA architecture. The numbers of logic blocks in a column, the relative widths of the columns, the number and order of columns, the types of logic blocks included in the columns, the relative sizes of the logic blocks, and the interconnect/logic implementations included at the top of FIG. 7 are purely exemplary. For example, in an actual FPGA, more than one adjacent column of CLBs is typically included wherever the CLBs appear, to facilitate the efficient implementation of user logic.

The embodiments of the present invention are thought to be applicable to a variety of ICs that may benefit from dynamic configuration of ESR. Other aspects and embodiments will be apparent to those skilled in the art from consideration of the specification. The embodiments may be utilized in conjunction with application specific integrated circuits (ASIC) or with programmable ICs. It is intended that the specification and illustrated embodiments be considered as examples only, with a true scope and spirit of the invention being indicated by the following claims.

What is claimed is:

1. An integrated circuit (IC), comprising:

a power distribution network having a first set of power distribution lines connected to a source voltage and a second set of power distribution lines connected to a ground voltage;

a first capacitor formed in the IC;

a first variable resistive element electrically coupled in series with the first capacitor between the first and second sets of power lines of the power distribution network; and a control circuit formed in the IC and coupled to the first variable resistive element, the control circuit configured and arranged to:

adjust a level of resistance of the first variable resistive element in response to an input signal, wherein adjustment of the level of resistance adjusts an equivalent series resistance of the power distribution network; and after adjusting of the level of resistance of the first variable resistive element, monitor an operating temperature of the IC and adjust the level of resistance of the first variable resistive element in response to and as a function of changes in the operating temperature of the IC.

2. The IC of claim 1, further comprising:

a memory element coupled to the control circuit;

wherein the control circuit is further configured and arranged to:

retrieve a value from the memory element, wherein the value is represented by the input signal and is indicative of a level of resistance; and bias a control input of the first variable resistive element by an amount commensurate with the retrieved value, wherein the level of resistance of the first variable resistive element is adjusted in response to the biased control input.

3. The IC of claim 1, further comprising:

a sampling circuit coupled to the control circuit and configured to measure noise on the power distribution network and provide the input signal to the control circuit, the input signal indicative of a measured noise level;

wherein the control circuit is further configured to adjust the level of resistance of the first variable resistive element in response to the measured noise level to reduce noise of the power distribution network.

4. The IC of claim 3, wherein the control circuit is configured to perform the adjusting in response to an initial application of power to the IC.

5. The IC of claim 1, wherein the control circuit is further configured and arranged to:

measure a first operating temperature of the IC at the startup of the IC;

measure a second operating temperature of the IC; and compare the first operating temperature to the second operating temperature.

6. The IC of claim 1, wherein the control circuit is further configured and arranged to:

measure a first temperature using a temperature sensor integrated in the IC and coupled to the control circuit;

measure a second temperature using a temperature sensor implemented external to the IC and coupled to the control circuit; and compare the first temperature to the second temperature.

7. The IC of claim 1, wherein the control circuit is further configured and arranged to:

retrieve an equivalent series resistance (ESR) drift value corresponding to a determined change in operating temperature from a memory of the IC; and adjust the level of resistance of the first variable resistive element as a function of the ESR drift value.

8. The IC of claim 1, wherein the variable resistive element comprises a MOSFET transistor having a gate coupled to and controlled by the control circuit.

9. The IC of claim 1, further comprising:

a second variable resistive element electrically coupled in series with a second capacitor between the first and second sets of power lines;

wherein the control circuit is coupled to the second variable resistive element and is further configured and arranged to adjust a level of resistance of the second variable resistive element in combination with adjusting the level of resistance of the first variable resistive element to adjust the equivalent series resistance of the power distribution network.

10. The IC of claim 1, wherein the second variable resistive element and second capacitor provide a maximum equivalent series resistance that is greater than a maximum equivalent series resistance provided by the first variable resistive element and first capacitor.

11. An integrated circuit (IC), comprising:

a first set of power distribution lines;

a second set of power distribution lines;

a plurality of equivalent series resistance (ESR) adjustment circuits, each including a capacitor and a transistor electrically coupled in series between the first and second sets of power distribution lines; and a control circuit configured and arranged to adjust an ESR of each ESR adjustment circuit by adjusting a gate voltage of the transistor of the ESR adjustment circuit; and wherein the control circuit is further configured and arranged to, after adjusting of the gate voltage of the transistor, monitor an operating temperature of the IC and adjust gate voltage of each ESR adjustment circuit in response to and as a function of changes in the operating temperature of the IC.

12. The IC of claim 11, further comprising:

a memory element coupled to the control circuit;

wherein the control circuit is further configured and arranged to, for each of the plurality of ESR adjustment circuits, retrieve a respective value form the memory element, wherein the value is indicative of a gate voltage at which the control circuit is to drive a gate of the transistor.

13. The IC of claim 11, further comprising:

a sampling circuit coupled to the control circuit, the sampling circuit configured and arranged to measure noise on the first and second sets of power distribution lines and output an input signal to the control circuit, the input signal indicative of a measured noise level;

wherein the control circuit is further configured and arranged to adjust the level of resistance of the transistor of one or more of the plurality of ESR adjustment circuits in response to the measured noise level to reduce noise of the first and second sets of power distribution lines.

14. The IC of claim 13, wherein the control circuit is configured and arranged to perform the adjustment in response to an initial application of power to the IC.

15. The IC of claim 11, wherein the control circuit is configured and arranged to adjust a level of resistance of transistors of the each of the plurality of ESR adjustment circuits, to adjust an equivalent series resistance of a power distribution network including the first and second sets of power distribution lines.

16. A method of adjusting equivalent series resistance (ESR) of an integrated circuit (IC), comprising: in response to initial application of power to the IC, for each resistance value of a plurality of different resistance levels: setting a resistance of a variable resistive element, coupled in series with a capacitor between a first set of power distribution lines coupled to a source voltage and a second set of power distribution lines coupled to a ground voltage, to the resistance value; adjusting the value of resistance of the variable resistive element as a function of a measured noise level to reduce noise on the first and second sets of power distribution lines to a respective local minima; and store a respective value indicative of the value of resistance of the variable resistive element that provides the respective local minima of noise on the first and second sets of power distribution lines; determine the smallest of the respective local minimas; and set the resistance of the variable resistive element to the value of resistance indicated by the stored resistance value corresponding to the smallest of the respective local minimas.

17. The method of claim 16, further comprising retrieving the plurality of different resistant levels from a memory element.

18. The method of claim 16, wherein:

adjusting the level of resistance of the variable resistive element includes measuring noise on first and second sets power distribution lines; and adjusting the level of resistance of the variable resistive element further includes adjusting the level of resistance as a function of the measured noise level to reduce noise of the first and second sets of power distribution lines.

19. The method of claim 16, further comprising after setting the resistance of the variable resistive element to the level of resistance indicated by the stored resistance value:

measuring an operating temperature of the IC; and adjusting the level of resistance of the variable resistive element in response to and as a function of changes in the measured operating temperature of the IC.

* * * * *